US007681260B2

(12) United States Patent
Hallock et al.

(10) Patent No.: US 7,681,260 B2
(45) Date of Patent: Mar. 23, 2010

(54) SAFETY BED HAVING ELEVATING MATTRESS

(75) Inventors: Joseph H. Hallock, Boones Mill, VA (US); Gregg Weinschreider, Rocky Mount, VA (US)

(73) Assignee: Sleep Safe Beds, LLC, Callaway, VA (US)

( * ) Notice: Subject to any disclaimer, the term of this patent is extended or adjusted under 35 U.S.C. 154(b) by 0 days.

(21) Appl. No.: 11/857,263

(22) Filed: Sep. 18, 2007

(65) Prior Publication Data

US 2008/0066230 A1 Mar. 20, 2008

Related U.S. Application Data

(60) Provisional application No. 60/845,476, filed on Sep. 18, 2006.

(51) Int. Cl.

| | |
|---|---|
| ***A47C 21/08*** | (2006.01) |
| ***A61G 7/05*** | (2006.01) |
| ***A61G 7/012*** | (2006.01) |
| ***A61G 7/015*** | (2006.01) |

(52) U.S. Cl. ..... 5/425; 5/424; 5/611; 5/613

(58) Field of Classification Search ..... 5/425, 5/424, 428, 430, 100, 611, 11, 610, 613, 5/600

See application file for complete search history.

(56) References Cited

U.S. PATENT DOCUMENTS

| | | | | | |
|---|---|---|---|---|---|
| 321,649 | A | * | 7/1885 | Shelley | 5/427 |
| 2,478,028 | A | * | 8/1949 | Travis | 5/100 |
| 2,651,785 | A | * | 9/1953 | Berner | 5/611 |
| 3,093,838 | A | | 6/1963 | Beasley | |
| 3,373,453 | A | * | 3/1968 | Goodman | 5/611 |
| 3,686,696 | A | * | 8/1972 | Lanigan | 5/611 |
| 3,763,507 | A | | 10/1973 | Propst | |
| 3,780,387 | A | | 12/1973 | Propst | |
| 4,227,269 | A | * | 10/1980 | Johnston | 5/611 |
| 4,345,344 | A | * | 8/1982 | Gadoury et al. | 5/610 |
| 4,398,313 | A | * | 8/1983 | Mitchell | 5/616 |
| 4,425,673 | A | * | 1/1984 | Werner | 5/611 |
| 4,675,926 | A | * | 6/1987 | Lindblom et al. | 5/618 |
| 4,715,074 | A | | 12/1987 | Wallace et al. | |
| 4,793,428 | A | | 12/1988 | Swersey | |
| 4,811,436 | A | | 3/1989 | Schwartz | |
| 4,868,937 | A | | 9/1989 | Connolly | |
| 4,953,244 | A | | 9/1990 | Koerber, Sr. et al. | |
| 4,974,692 | A | | 12/1990 | Carruth et al. | |
| 4,979,246 | A | * | 12/1990 | Godin et al. | 5/93.1 |
| 5,033,563 | A | | 7/1991 | Brainerd, Jr. et al. | |
| 5,384,925 | A | * | 1/1995 | Vail | 5/424 |

(Continued)

FOREIGN PATENT DOCUMENTS

FR 2 726 982 A 5/1996

*Primary Examiner*—Robert G Santos
(74) *Attorney, Agent, or Firm*—Charles S. Sara, Esq.; DeWitt Ross & Stevens, S.C.

(57) ABSTRACT

A safety bed including a bed frame, pivotally attached guard rails, and a vertically adjustable mattress support structure. The mattress support structure capable of being lowered within the confines of the bed frame to prevent a patient from crawling out of the safety bed. The mattress support structure capable of being raised within the bed frame to grant a health care provider access to the patient.

22 Claims, 10 Drawing Sheets

U.S. PATENT DOCUMENTS

| | | | | |
|---|---|---|---|---|
| 5,742,959 | A | 4/1998 | Froelich | |
| 5,926,870 | A | 7/1999 | Branca-Barnes et al. | |
| 6,216,291 | B1 * | 4/2001 | Eads et al. | 5/424 |
| 6,453,491 | B1 | 9/2002 | Wells et al. | |
| 6,487,735 | B1 | 12/2002 | Jacques, II et al. | |
| 6,516,478 | B2 * | 2/2003 | Cook et al. | 5/611 |
| 6,687,930 | B1 * | 2/2004 | Eads et al. | 5/414 |
| 6,694,547 | B1 * | 2/2004 | Vail | 5/424 |
| 6,772,458 | B2 * | 8/2004 | Ellen et al. | 5/424 |
| 7,076,817 | B1 | 7/2006 | Garver | |
| 7,415,740 | B1 * | 8/2008 | Kemper | 5/424 |
| 7,430,770 | B2 * | 10/2008 | Ramirez | 5/424 |
| 2003/0135923 | A1 | 7/2003 | Godin et al. | |
| 2006/0162070 | A1 | 7/2006 | Lawlor et al. | |
| 2008/0066230 | A1 * | 3/2008 | Hallock et al. | 5/600 |

* cited by examiner

SAFETY BED HAVING ELEVATING MATTRESS

REFERENCE TO RELATED APPLICATION

The application claims priority to U.S. Provisional Application entitled "SAFETY BED HAVING ELEVATING MATTRESS," Ser. No. 60/845,476, filed Sep. 18, 2006, which is incorporated herein by reference in its entirety.

FIELD OF THE INVENTION

The present invention is directed to a safety bed primarily for use in care for patients with physical and developmental disabilities where special circumstances require a bed designed to reduce the possibility of injury to the patient. Specifically, a bed is required which would prevent falls and entrapment for individuals who need care.

DESCRIPTION OF THE PRIOR ART

Safety beds are well known and described in the field, such as those which are commonly found in certain medical and geriatric facilities. Generally, these beds include a guard rail assembly which can be raised to prevent the patient from falling out of the bed and lowered to allow the patient ingress and egress from the bed. Known guard rail assemblies, such as those described in U.S. Pat. No. 5,742,959, typically include a top and a bottom horizontal rail as well as a series of spaced vertical bars there between. Such assemblies are therefore a lattice type of structure having a number of associated gaps. Other safety or guard rail assemblies for cribs, such as described in U.S. Pat. No. 5,926,870, have similarly "gapped" structures.

In spite of fairly strict governmental standards that have been specifically mandated for the construction of safety beds, there have been numerous reported instances in which a patient has fallen not only through gaps in a guard rail assembly, but also between other gaps often created between the lateral side of the mattress and box spring and the guard rail assembly, and between various portions of the bed frame itself. These injuries can not only be traumatic but also catastrophic, producing entrapment and possibly death. Therefore, there is an urgent need in the field to provide a safety bed which all but eliminates the probability of such injuries as those described above.

Reference is specifically made to U.S. Pat. No. 6,453,491 to Wells et al. which describes a safety bed having a releasable guardrail assembly. The guard rail assembly includes at least one guard member sized to extend over an entire lateral side of the frame of the bed. In addition, there is a means for releasably attaching the guard member to the bed frame. The means includes a hinge for attaching the lower end of the guard member to the bed frame. The guard member can then be selectively pivotally moved between a first raised position and a second lowered position. When the guard rail is in the first position, the guard member is in compressive contact with a lateral side of the mattress to minimize the existence of gaps between the bed frame, the guard member, and the mattress. When the guard member is in the second position, the rail permits a patient ingress and egress from the bed. When the guard member is secured in the first position the patient is prevented from falling out of the bed. At the same time, the guard member also prevents or at least substantially minimizes the incidences of gap-related injuries which can occur using standard known guardrail assemblies.

Although safety beds have been improved to prevent entrapment of a patient between the mattress and the side rail, none of the prior art have addressed the problem of patients crawling out of the bed. A restless patient can easily climb over top of the side rails and potentially fall to the floor. Potential solutions to this problem are included in U.S. Pat. No. 5,926,870, which includes unusually high end and side panels. The high end and side panels create a higher barrier, which is harder for the patient to climb over. A similar solution has been proposed in U.S. Pat. No. 4,811,436, which creates a higher barrier for a patient. The design of these two patents places the patient in a fixed location and with the side rails up, out of reach of the health practitioner. In order to access the patient, the health practitioner must fold down the guard rails and likely bend over to reach the patient. These designs both create an uncomfortable work environment for the practitioner, as well as a potential safety risk for the patient.

A safety bed should not only attend to the patient's needs, but also create a more efficient work space for the health practitioner. A safety bed should combine the safe enclosure of high side walls for the patient, as well as a high mattress position to assist the health practitioner. Therefore, a need exists to combine safety features for the patient and assist the practitioner in caring for the patient.

SUMMARY OF THE INVENTION

Referring now to the figures for reference numbers, the present invention is directed to a safety bed 10 for patients with physical and developmental disabilities, the safety bed comprising a bed frame 14, the bed frame including a headboard 30, a footboard 34, and a pair of side rails 38 which interconnect the headboard 30 and the footboard 34; and a mattress support frame within the bed frame 14 for supporting a mattress and for raising and lower the mattress with the bed frame.

The present invention is also directed to a safety bed 10 for patients with physical and developmental disabilities, the safety bed comprising a bed frame 14, the bed frame including a headboard 30, a footboard 34, and a pair of side rails 38 which interconnect the headboard 30 and the footboard 34; at least one pair of removable guard members 64, 68, each of the guard members being disposed on an opposing lateral side of the bed frame 14, the guard members 64 being sized to occupy the entirety of the lateral space between the footboard 34 and the headboard 30 such that there are no gaps therebetween; and a mattress support frame within the bed frame 14 for supporting a mattress and for raising and lower the mattress with the bed frame.

The present invention is also directed to a safety bed 10 for patients with physical and developmental disabilities, the safety bed comprising a bed frame 14, the bed frame including a headboard 30, a footboard 34, and a pair of side rails 38 which interconnect the headboard 30 and the footboard 34; at least one pair of removable guard members 64, 68, each of the guard members being disposed on an opposing lateral side of the bed frame 14, the guard members 64 being sized to occupy the entirety of the lateral space between the footboard 34 and the headboard 30 such that there are no gaps therebetween, wherein the guard members include at least one locking member 80 for engagement of the guard members with the bed frame; and a mattress support frame within the bed frame 14 for supporting a mattress and for raising and lower the mattress with the bed frame, wherein the mattress support frame includes support legs 218, a fixed lower substructure 212 fixed on the support legs 218, and an elevating upper substructure 210 fixed to the lower substructure 212; and a scissor linkage to affix the elevating upper substructure to the fixed lower substructure, wherein the scissor linkage 208 comprises at least one set of cross bars 209 form a scissor hinge 219, wherein each of the set of cross bars 209 rotatably connects at a fixed position 226 on both the upper substructure 210 and the lower substructure 212.

The primary patentable feature is the combination of the safety bed described in the '491 patent to Wells et al. and the adjustable (hi-lo) feature allowing for the electronic elevation and lowering of the mattress within the safety bed. The bed of the present invention allows seamless, remote control high and low mattress adjustment. Advantages of the present invention include an adjustable mattress height. The mattress height, surface-to-floor, can be remotely controlled and be positioned at any height from 17 inches to 34 inches; thus, allowing for more comfort for the user and the caregiver. The adjustable mattress height allows the distance from the surface of the mattress to the top of the safety rail to be varied from 1 inch to 36 inches, preferably 8 inches to 25 inches. Varying the height of the mattress within the frame does not compromise the geometry of the bed and frame and maintains the minimal gaps between frame and mattress throughout the full range of motion. The articulated mobility of the mattress easily allows for the raising of the back portion and/or knee portion. The bed includes adaptable, full-length safety rails that combine the strength of solid wood with clear PETE panels.

The bed includes a rigid construction with a high-low bed frame, which utilizes heavy tubular steel to maximize strength and stability of the sleep surface in all positions. The present invention includes a full-electric hand-held remote operation that uses ultra whisper quiet, rapid-moving DC motors. Preferably, the motor has a dynamic operating capacity of 400 pounds and meets all necessary Underwriter Laboratory® (UL) safety standards for medical beds. The present invention helps the patient because caregivers have full view for easy monitoring. The bed's user can see his environment, thus reducing the chance of claustrophobia and encouraging a comfortable rest. The headboard and footboard extend below the mattress and box spring reducing the risk of entrapping an arm and leg.

The advantage of the safety bed of the present invention is that not only is it visually appealing, but it also addresses safety issues in a variety of ways, including providing clear polyethylene terephthalate ("PETE") windows incorporated in the safety rails to prevent the opportunity for entanglement in contrast to traditional institutional beds. The present invention also virtually eliminates entrapment issues. The space between side rails, headboard and footboard is nearly nonexistent even with compression. The aesthetics and hardwood construction of the bed promote a "homey" atmosphere for the benefit of not only the resident whose self-esteem may be an issue, but also for family members and caregivers who appreciate a more normalized setting.

Another advantage of the present invention is that the guard member when secured in the first position will prevent the patient from falling out of the bed, while also preventing or at least substantially minimizing the incidence of "gap-related" injuries, which can occur using standard guard rail assemblies. The present guard rail adapter and the safety bed using the adapter are in compliance with the strict governmental standards which are required for facility safety beds.

A further advantage of the present invention is that the guard member is easily movable between the first and second position for a caregiver, but not for the patient. In addition, the adapter easily can be removed from the bed frame without requiring tools or intensive labor or modifications.

A second embodiment of the present invention is illustrated in FIGS. 5 and 6. The second embodiment includes a second or upper guard rail assembly on each side of the safety bed. With the addition of the upper rail guard, the height of the entire bed and frame can be increased, while the mattress can still be raised and lowered as in the single guard rail safety bed. By adding an upper guard rail and increasing the overall height of the bed, the patient is more fully enclosed inside the bed frame. The extra height of the bed frame creates a safe enclosure for a taller patient, who may be able to crawl out of a lower safety bed, with only a single guard rail assembly.

The objects and advantages of the invention will appear more fully from the following detailed description of the preferred embodiment of the invention made in conjunction with the accompanying drawings.

DETAILED DESCRIPTION OF THE INVENTION

The following description relates to a safety bed design according to a specific embodiment. It will be readily apparent from the following discussion, however, that certain variations and modifications can easily be imagined within the inventive concepts as claimed herein. Furthermore, certain terms are used throughout this discussion such as "upper," "lower," "lateral" and the like which assist in providing a frame of reference with regard to the accompanying drawings. These terms, however, should not necessarily be construed as limiting of the present invention, except as otherwise stated herein.

Figure 1:
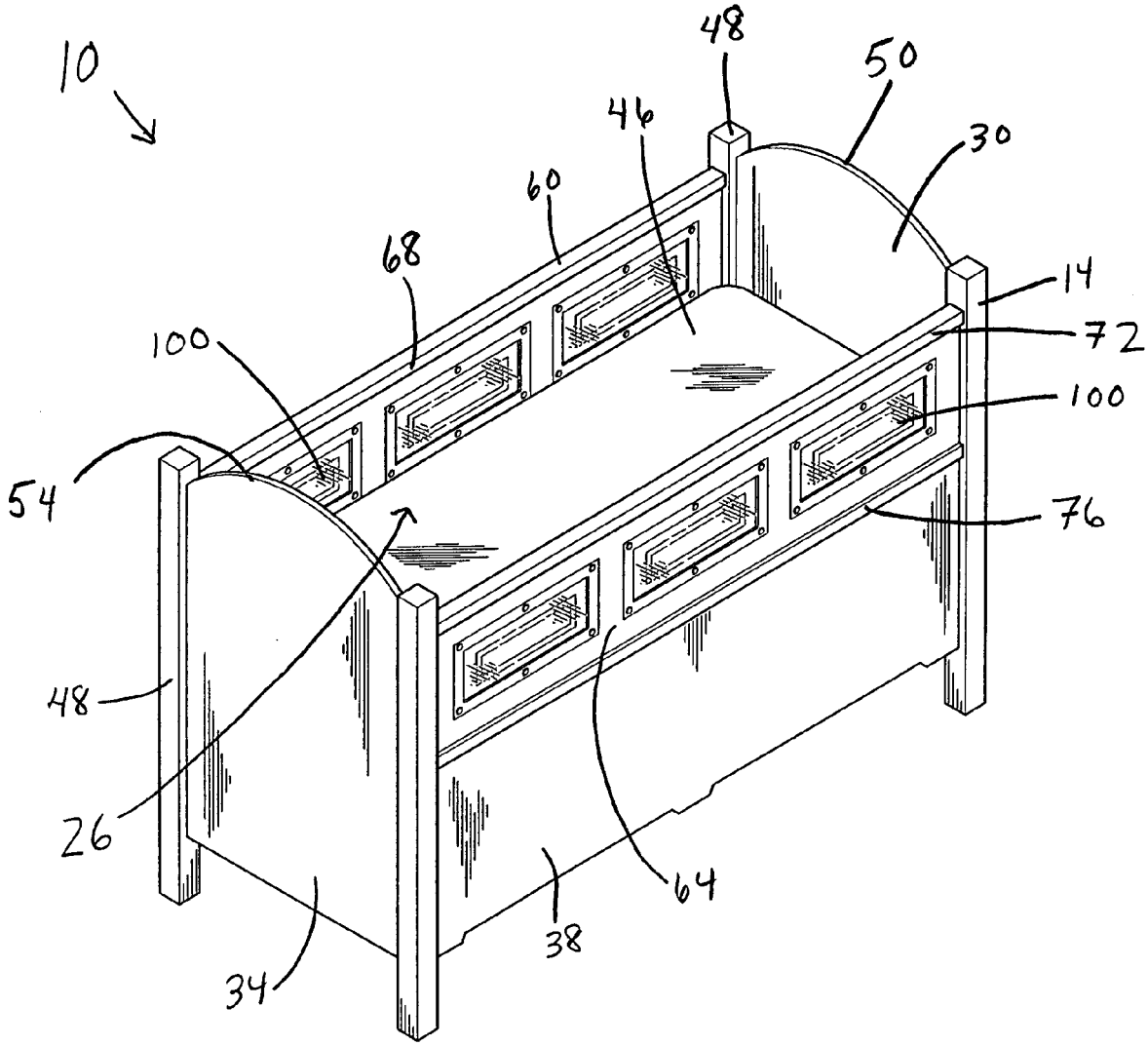
FIG. 1 is a top-perspective illustration of the safety bed with a single guard rail assembly and the mattress in the upper position.

Referring to FIG. 1, there is illustrated a safety bed 10, with the mattress 26 in the upper position in accordance with the preferred embodiment of present invention. The safety bed includes a wooden bed frame 14, the frame including a headboard 30, a footboard 34, and a pair of side rails 38 (only one of which is shown in FIG. 1), which interconnect the headboard 30 and the footboard 34. The bed frame 14 and each of the preceding components collectively define a supporting structure for a stacked mattress 26 and box spring (not shown). Each of the headboard 30 and footboard 34 extend above an upper surface 46 of the mattress 26, the headboard 30 and footboard 34 each including a pair of bed posts 48 which are secured to a unitary member 50, 54, respectively, the posts being secured thereto using conventional furniture fastening techniques, such as a knockdown fitting having an eccentric cam so as to reduce forward play in each of the interconnected components.

Figure 2:
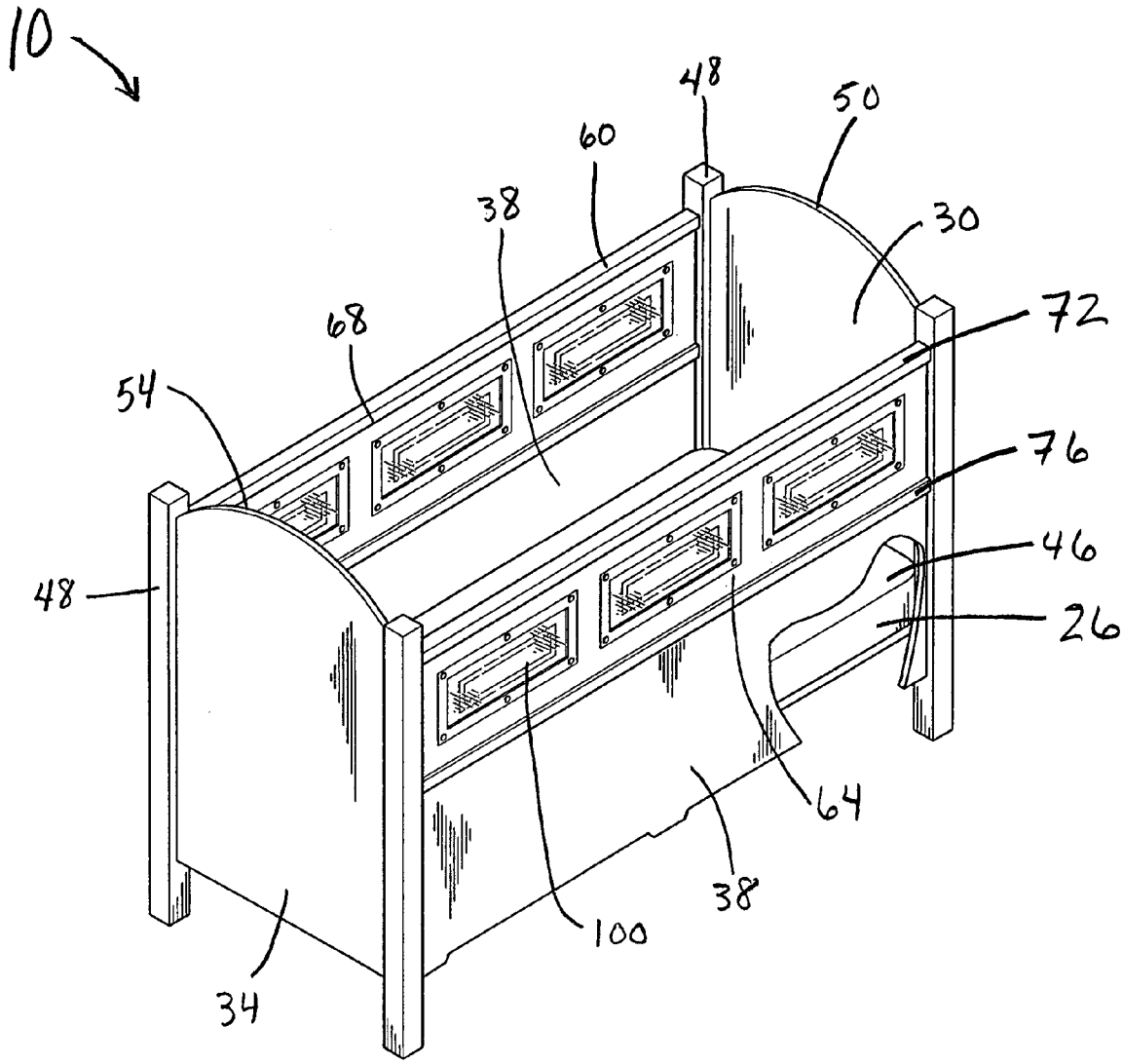
FIG. 2 is a top-perspective illustration of the safety bed with a single guard rail assembly and the mattress in the lower position, which is visible in the cut-away.

Referring to FIGS. 1 and 2, a guard rail adapter 60 according to the preferred embodiment includes a pair of guard members 64, 68, each of the guard members being disposed on an opposing lateral side of the bed frame 14. For purposes of the discussion which follows, only details specific to one of the guard members 64 are provided, though it should be understood that the remaining guard member 68 is identical in appearance and function.

More specifically, and referring to FIGS. 1-6, the guard member 64 includes an upper end 72 and a lower end 76, the guard members being substantially planar members made from wood having a grain preferably like that of the bed frame 14. The guard member 64 is sized to occupy the entirety of the lateral space between the footboard 34 and the headboard 30; that is, the length of a side rail 38 without any gaps therebetween.

Figure 6A:
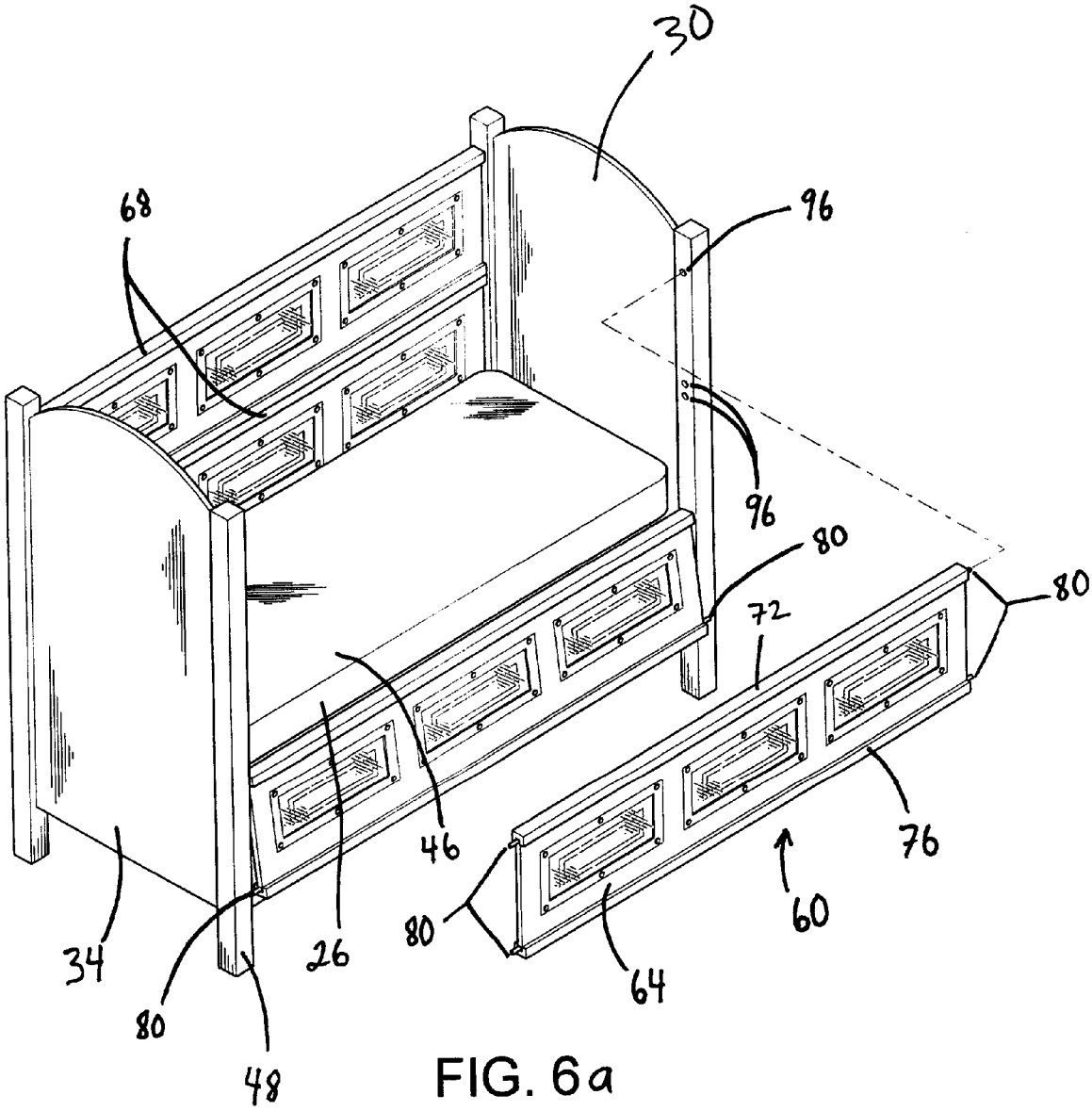
FIG. 6*a* is a top-perspective illustration of the safety bed with a double guard rail assembly. The upper guard rail assembly is detached and the lower guard rail assembly is folded down.
Figure 6B:
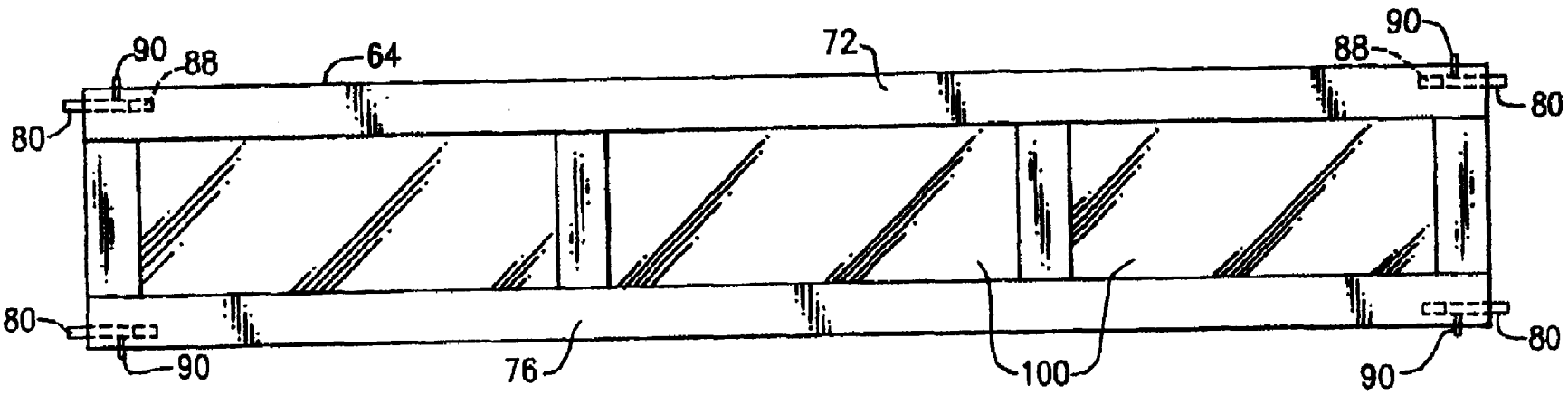
FIG. 6*b* is a side view of a guard rail.
Figure 6C:
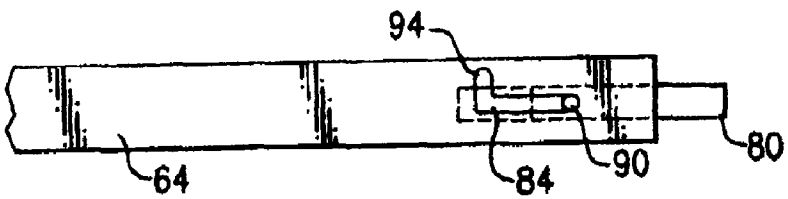
FIG. 6*c* is an enlarged partial top view of the locking mechanism for a guard rail.

Referring to FIGS. 6*a*-6*c*, a locking member 80 extends from respective opposing sides of the upper end 72 and the lower end 76 of the guard member 64 for engagement with a corresponding number of openings 96 which are provided in the bed posts 48. For purposes of this embodiment, the locking members 80 are pins housed within openings provided in each of the upper end 72 and the lower end 76 of the guard member 64, the pins being preferably though not necessarily biased into a deployed position by means of a spring 88. Each of the locking members 80 can be retracted by means of a lever 90 which is connected to one end of each locking member, the lever being movable to an inset position along an L-shaped slot 84 which retracts the pin to a unlocked slot position 94. It will be readily apparent to one of ordinary skill in the field that other release mechanisms can be utilized to unlock either the upper and/or lower end 72, 76 and should not be limited by the specific mechanism described herein. Moreover, and in conjunction with the openings 96, a strike plate (not shown) could be added to each of the bed posts 48, the strike plate having a ramped slot extending to the opening 96, such that the upper end 72 of the guard member 64 can be aligned relative to the openings 96 laterally mounted to the bed frame 14 without first having to retract the locking members 80 in assembly.

Figure 3:
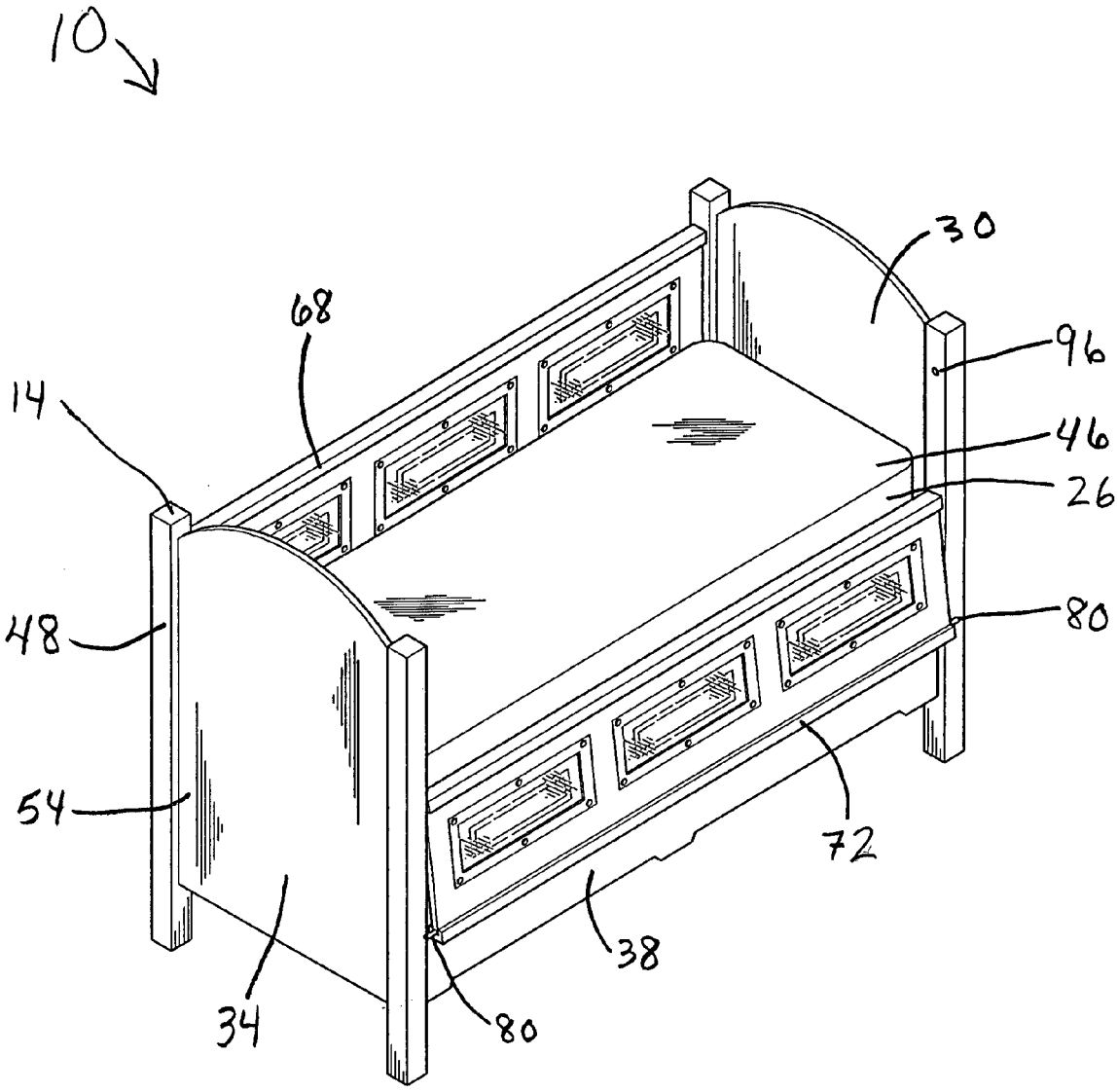
FIG. 3 is a top-perspective illustration of the safety bed with a single guard rail assembly and the mattress in the upper position. The guard rail assembly is in the lowered position.

The guard member 64 has a corresponding height dimension such that the upper end 72 of the member can pivot about the lower end 76 between a first or raised position, such as shown in FIG. 1, and a second or lowered position, such as shown in FIG. 3. The axis defining the pivot axis of the lower end 76 is stationary throughout the pivoting action, this axis always being beneath the upper surface 46 of the mattress 26. Each of the first and second positions assumable by the guard member 64 as shown in FIGS. 1 and 3, respectively, are substantially in the same lateral plane as the side rail 38.

Each of the guard members 64, 68 include a set of transparent windows 100 made from Plexiglas, polycarbonate, or other suitable material, the windows being disposed between the upper and lower ends 72, 76, and permitting a caregiver to monitor a resting patient from a sitting position without having to first look over the guard member 64. Though three windows are shown, any number of windows can be provided; for example, a single window (not shown) extending over the length of the guard member 64 could be substituted.

Referring to the Figs. in general and in operation, the guard member 64 is herein first described as attached to the bed frame 14 and in the first position assumed in FIG. 1. In this raised position, the patient (not shown) cannot fall out of the bed in that the upper end 72 of the guard member 64 is substantially above the upper surface 46 of the mattress 26. Furthermore, because the guard member 64 extends along the entire lateral side of the bed frame 14 and includes no gaps, either within the guard member itself or between the lateral side of the mattress 26 and the guard member, the risk of injury is greatly minimized.

Retraction of each of the locking members 80 located at the upper end 72 of the guard rail adapter 60 is accomplished by pulling each of the levers 90 against the bias of springs 88 and placing the lever 90 within respective unlocked slot positions 94, thereby releasing the upper end and permits the guard rail member 64 to pivot downwardly about the lower end 76 from the first position, shown in FIG. 1, to the second position, as shown in FIG. 3. In this lowered position, the patient (not shown) can easily get into and out of the bed as needed.

Figure 4:
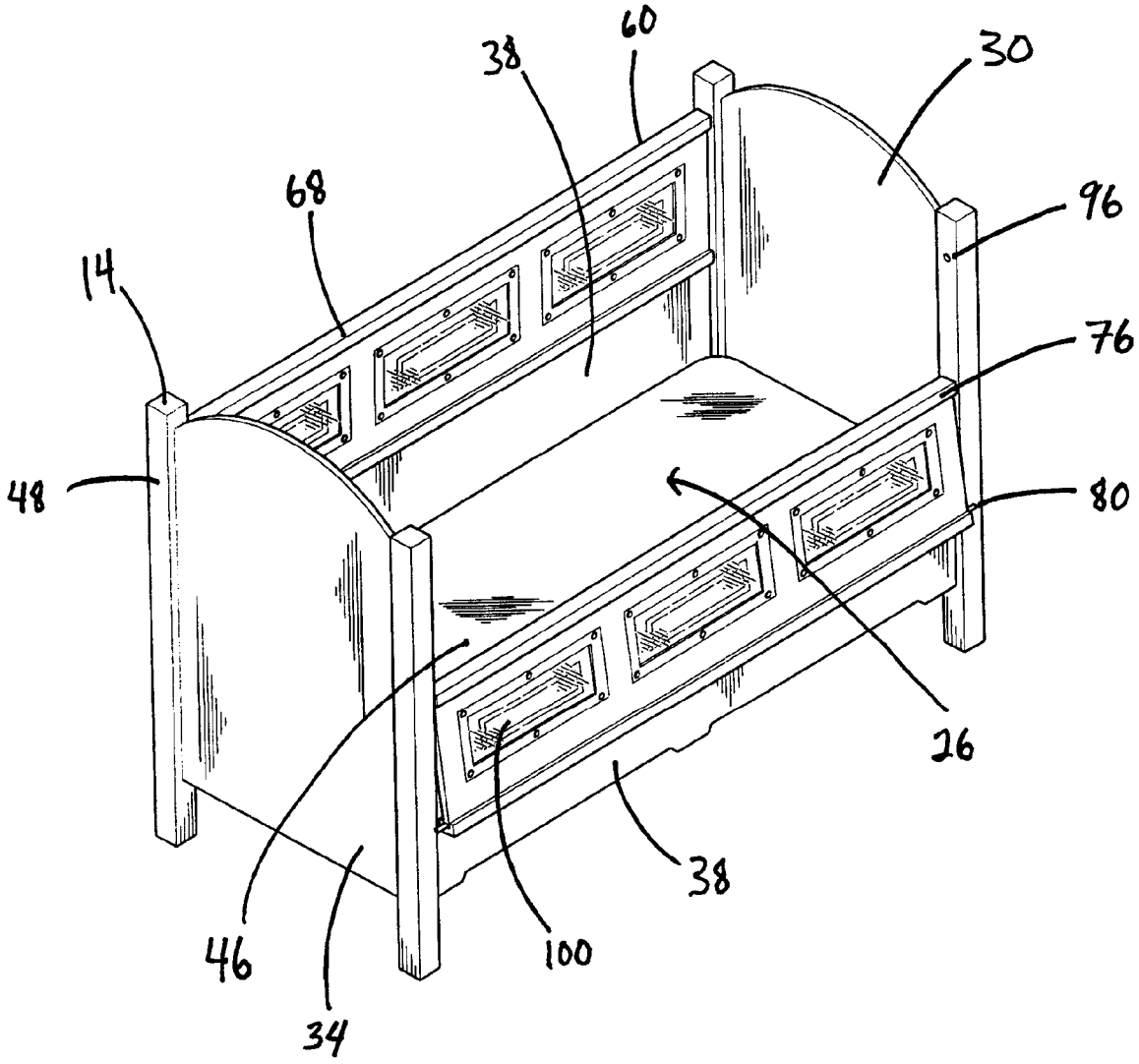
FIG. 4 is a top-perspective illustration of the safety bed with a single guard rail assembly and the mattress in the lower position, which is visible in the cut-away. The guard rail assembly is in the lowered position.

In order to remove the guard rail adapter 60 from the bed frame 14 from the first position, as shown in FIGS. 1 and 2, the guard member 64 is first pivoted to the second position, as shown in FIGS. 3 and 4, as described above, by releasing the locking members 80 at each opposing side of the upper end 72. Once the member 64 has been pivoted, the locking members 80 at the lower end 76 of the guard member 64 can also be retracted in a similar manner by pulling each of the levers 90 against the biasing of springs 88 to unlock the lower end and remove the guard member from the bed frame 14, as shown in FIG. 6*a*. Though not shown, guard member 68 can be similarly removed. As noted and upon removal of the guard rail adapter 60, the safety bed 10 looks no different than a standard twin size bed and can be used for that purpose.

Additionally, FIG. 1 shows the mattress 26 in the raised position, and close to the top of the bed frame 14. In the raised position, a patient lying on the mattress 26 can easily be attended to by a health practitioner. The transparent windows 100 in the guard rails 64, 68 allow the patient to look out into the environment. With the guard rail 64 in the upper position, the patient is still safely enclosed in the safety bed 10. If the practitioner needs to have better access to the patient, the guard rail 72 can be lowered as shown in FIG. 3.

Referring to FIG. 2, the mattress 26 can be lowered within the confines of the bed frame 14, so that the upper surface of the mattress 46 is well below the top of the guard rails 64, 68. With the mattress 26 in the lowered position, the patient is safely held within the walls of the safety bed 10. The windows 100 in the guard members 64, 68 allow light into the safety bed 10, even when the mattress 26 is in the lowered position. This adds to the comfort of the patient. As shown in FIG. 4, a health provider can still access the patient when the mattress 26 is in the lowered position. The guard member 64 can be lowered to allow greater access to the patient. However, even when the guard member 64 is lowered, the top of the mattress 46 is still below the lower end 76 of the guard member 64. Even when the mattress 26 is in the lowered position, there is still a significant barrier for the patient to escape from the safety bed 10.

Figure 5:
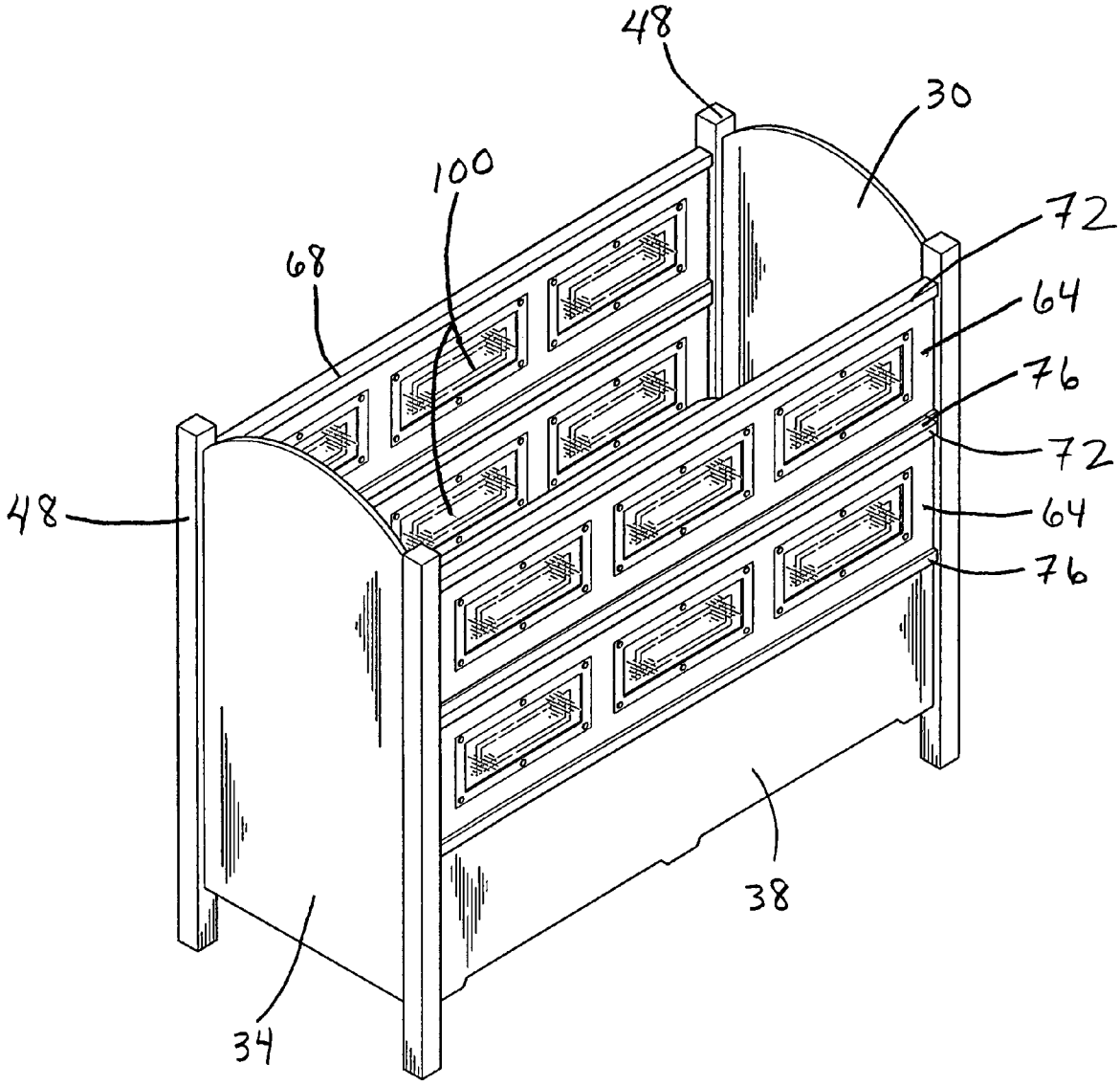
FIG. 5 is a top-perspective illustration of the safety bed with a double guard rail assembly.

The second embodiment of the present invention is shown in FIGS. 5 and 6*a*. The second embodiment includes a double set of guard members 64, 68 on each side of the safety bed 10. The addition of double guard rails 64, 68 increases the overall height of the bed frame 48, and is appropriate for taller patients. When the mattress 26 is in the lowered position, even a patient of significant height will be safely enclosed in the safety bed 10. In order to access the patient, the mattress 26 can be raised and the guard rails either removed and/or lowered, as shown in FIG. 6*a*.

Figure 7:
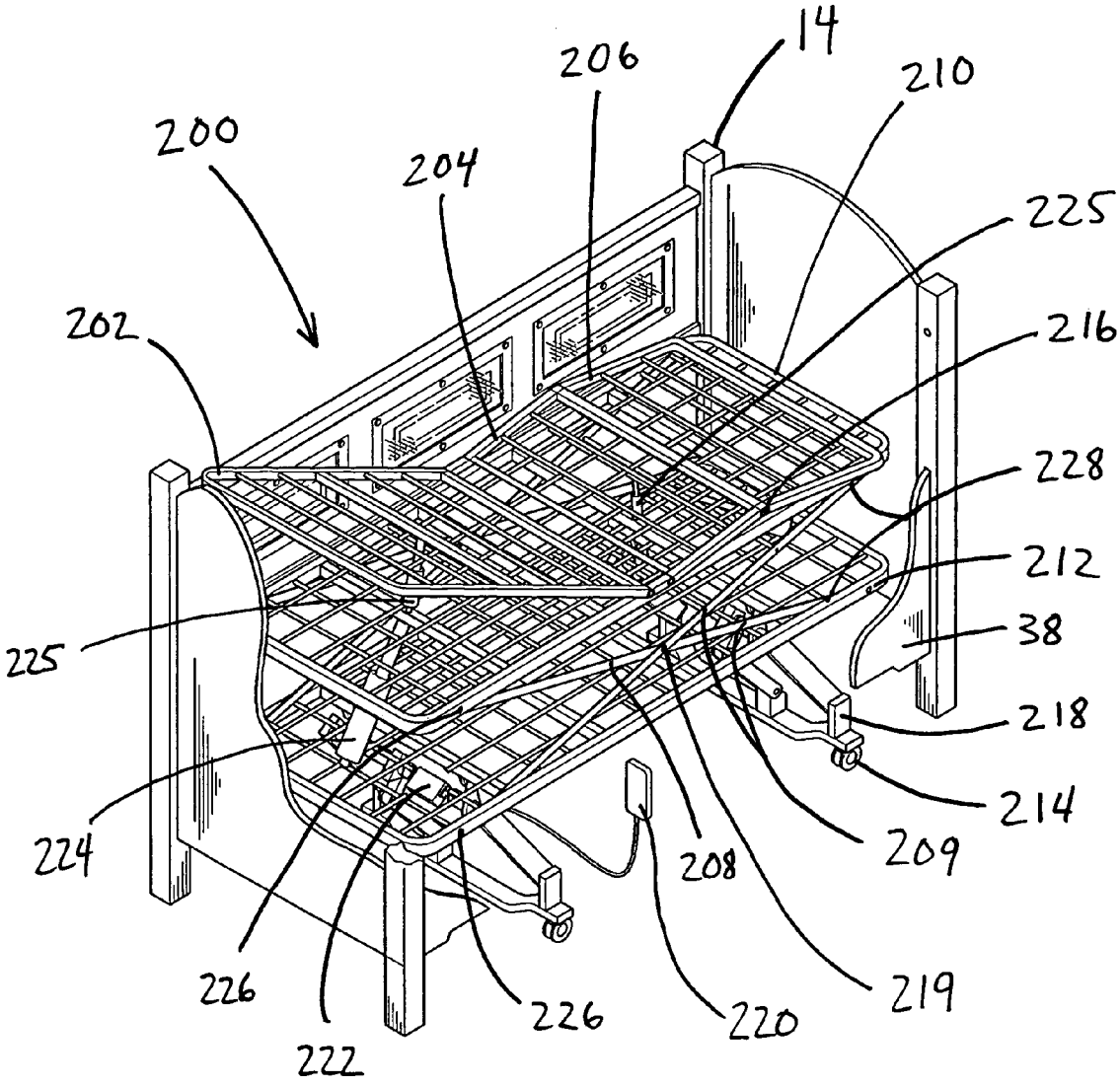
FIG. 7 is a perspective, partially cut away view of the safety bed of the present invention illustrating the mechanism by which the mattress is raised and lowered, and by which the mattress is actuated.

Referring now to FIG. 7, the mattress support structure 200 is illustrated in a raised position, which places a patient close to the top of the bed frame 14. The mattress support structure 200 is supported by support legs 218, which are on top of casters or wheels 214. The casters 214 allow the mattress support structure 200 to roll more easily. The mattress support structure 200 is preferably made of heavy tubular steel to maximize the strength and stability of the sleep surface in all positions. The lower substructure 212 remains fixed on top of the support legs 218. The upper substructure 210 is connected above the lower substructure 212 by a scissor linkage 208. The scissor linkage 208 is comprised of cross bars 209 which come together at a scissor hinge 219. Each cross bar 209 rotatably connects at a fixed position 226 on either the upper substructure 210 or the lower substructure 212. The opposite end of the cross bar 209 interacts via a roller joint 228 with either the upper substructure 210 or lower substructure 212. An electric motor 222 operates a piston 224 which raises the upper substructure 210 in relation to the fixed lower substructure 212. As the piston 224 pushes the upper substructure 210, the scissor linkage 208 expands, thus moving the roller joints 228 towards the center of the mattress support structure 200. When the electric motor 222 stops, the piston 224 holds the upper substructure 210 in place. The electric motor 222 is controlled by a remote control 220. Although an electric motor 222 and piston 224 are shown as the exemplary mechanism to raise the mattress support structure 200, it is within the scope of this invention to use additional mechanisms to accomplish the same task. Additionally, although a scissor linkage 208 is shown, other linkages such as parallelogram could also be used.

Figure 8:
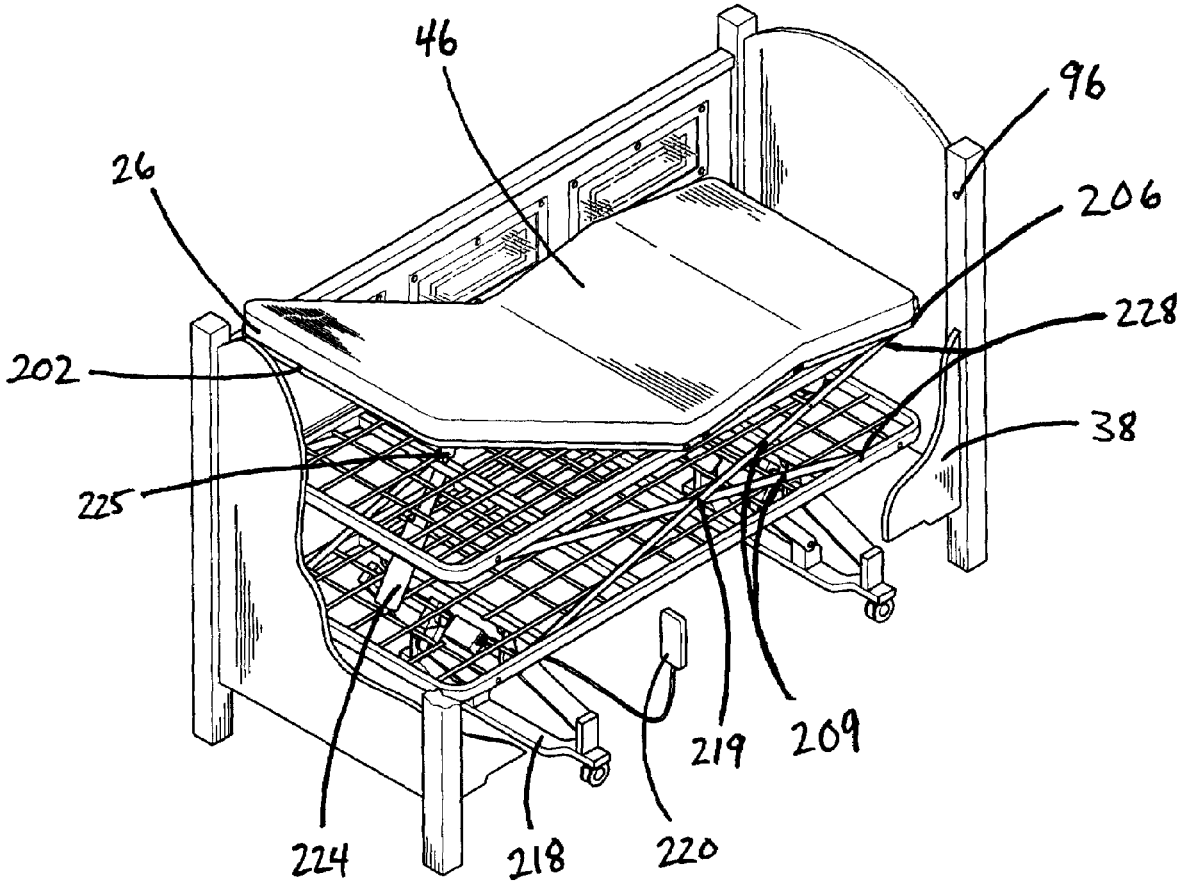
FIG. 8 is a perspective, partially cut away view of the safety bed of the present invention illustrating the mattress in the upper position with the head and knees raised.
Figure 9:
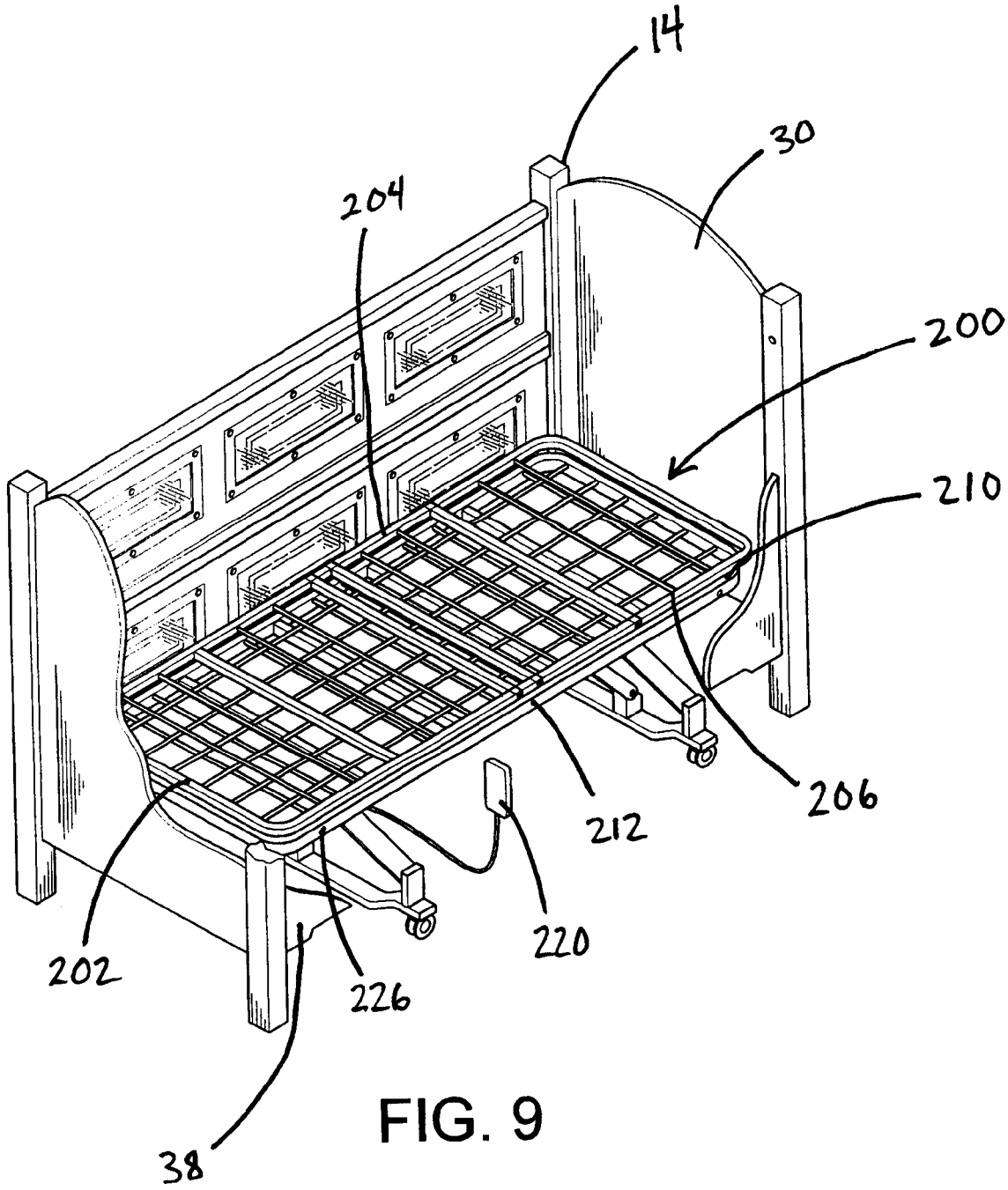
FIG. 9 is a perspective, partially cut away view of the safety bed of the present invention illustrating the mechanism by which the mattress is raised and lowered, and by which the mattress is actuated. The mechanism is in a collapsed position.

As shown in FIGS. 7 and 8, the mattress support structure 200 has articulating joints 216 which separate the head section 202, the thigh section 204, and the foot section 206. The articulating joints 216 allow the head section 202, thigh section 204 and foot section 206 to raise and lower independently. This allows for greater patient comfort. The remote control 220 can control additional DC motors (not illustrated) to operate actuating pistons 225 to raise and lower the sections. FIG. 8 specifically shows the mattress 26 resting in an articulated position on top of the mattress support structure 200. FIGS. 7 and 8 also show the mattress support structure 200 in a raised position close to the top of the bed frame 14. In contrast, FIG. 9 illustrates the mattress support structure 200 in the lowered position, recessed from the top of the bed frame 14. This is representative of the mattress position in FIGS. 5 and 6, and includes the double stacked guard rail member.

It is understood that the invention is not confined to the particular construction and arrangement of parts herein illustrated and described, but embraces such modified forms thereof as come within the scope of the following claims.

What is claimed is:

1. A safety bed for patients with physical and developmental disabilities, the safety bed comprising:

a. a bed frame of substantially rigid construction to prevent gaps from forming between the bed frame and a mattress positioned within the bed frame, the bed frame including a headboard, a footboard, and a pair of side rails which interconnect the headboard and the footboard; and b. a mattress support frame that is not connected to and disposed within the bed frame for supporting the mattress and for raising and lowering the mattress within the bed frame, wherein the headboard and footboard extend below the mattress; and wherein the mattress is in compressive contact with the bed frame such that there are no gaps between the mattress and the bed frame.

2. The safety bed of claim 1 further wherein the bed frame further comprises at least one pair of removable guard members each of the guard members being disposed on an opposing lateral side of the bed frame, the guard members being sized to occupy the entirety of the lateral space between the footboard and the headboard such that there are no gaps therebetween.

3. The safety bed of claim 2 wherein the guard members include at least one locking member for engagement of the guard members with the bed frame.

4. The safety bed of claim 2 wherein the guard members include at least one transparent window disposed between the upper and lower ends of the guard members.

5. The safety bed of claim 1 wherein the mattress support frame includes casters or wheels.

6. The safety bed of claim 1 wherein the mattress support frame includes support legs, a fixed lower substructure fixed on the support legs, and an elevating upper substructure fixed to the lower substructure.

7. The safety bed of claim 6 further comprising a scissor linkage to affix the elevating upper substructure to the fixed lower substructure, wherein the scissor linkage comprises at least one set of cross bars forming a scissor hinge, wherein each of the at least one set of cross bars rotatably connects at a fixed position on both the upper substructure and the lower substructure.

8. The safety bed of claim 6 wherein the mattress support frame includes a motor for raising the elevating upper substructure in relation to the fixed lower substructure.

9. The safety bed of claim 6 further comprising a remote control for operating the elevating upper substructure.

10. The safety bed of claim 1 wherein the mattress support structure includes articulating joints forming a head section, a thigh section, and a foot section.

11. The safety bed of claim 1 wherein the mattress substantially occupies the entirety of the lateral space between the side rails and between the headboard and the footboard when the mattress is horizontal such that there are substantially no gaps between the mattress and the frame when the mattress is horizontal.

12. A safety bed for patients with physical and developmental disabilities, the safety bed comprising:

a. a bed frame of substantially rigid construction to prevent gaps from forming between the bed frame and a mattress positioned within the bed frame, the bed frame including a headboard, a footboard, and a pair of side rails which interconnect the headboard and the footboard;

b. at least one pair of removable guard members, each of the guard members being disposed on an opposing lateral side of the bed frame, the guard members being sized to occupy the entirety of the lateral space between the footboard and the headboard such that there are no gaps therebetween; and c. a mattress support frame that is not connected to and disposed within the bed frame for supporting the mattress and for raising and lowering the mattress within the bed frame, wherein the headboard and footboard extend below the mattress; and wherein the mattress is in compressive contact with the bed frame such that there are no gaps between the mattress and the bed frame.

13. The safety bed of claim 12 wherein the guard members include at least one locking member for engagement of the guard members with the bed frame.

14. The safety bed of claim 12 wherein the guard members include at least one transparent window disposed between the upper and lower ends of the guard members.

15. The safety bed of claim 12 wherein the mattress support frame includes casters or wheels.

16. The safety bed of claim 12 wherein the mattress support frame includes support legs, a fixed lower substructure fixed on the support legs, and an elevating upper substructure fixed to the lower substructure.

17. The safety bed of claim 16 wherein the mattress support frame includes a motor for raising the elevating upper substructure in relation to the fixed lower substructure.

18. The safety bed of claim 16 further comprising a remote control for operating the elevating upper substructure.

19. The safety bed of claim 12 further comprising a scissor linkage to affix the elevating upper substructure to the fixed lower substructure, wherein the scissor linkage comprises at least one set of cross bars forming a scissor hinge, wherein each of the at least one set of cross bars rotatably connects at a fixed position on both the upper substructure and the lower substructure.

20. The safety bed of claim 12 wherein the mattress support structure includes articulating joints forming a head section, a thigh section, and a foot section.

21. The safety bed of claim 12 wherein the mattress substantially occupies the entirety of the lateral space between the side rails and between the headboard and the footboard when the mattress is horizontal such that there are substantially no gaps between the mattress and the frame when the mattress is horizontal.

22. A safety bed for patients with physical and developmental disabilities, the safety bed comprising:

a. a bed frame of substantially rigid construction to prevent gaps from forming between the bed frame and a mattress positioned within the bed frame, the bed frame including a headboard, a footboard, and a pair of side rails which interconnect the headboard and the footboard;

b. at least one pair of removable guard members, each of the guard members being disposed on an opposing lateral side of the bed frame, the guard members being sized to occupy the entirety of the lateral space between the footboard and the headboard such that there are no gaps therebetween, wherein the guard members include at least one locking member for engagement of the guard members with the bed frame;

c. a mattress support frame that is not connected to and disposed within the bed frame for supporting the mattress and for raising and lowering the mattress within the bed frame, wherein the mattress support frame includes support legs, a fixed lower substructure fixed on the support legs, and an elevating upper substructure fixed to the lower substructure, wherein the headboard and footboard extend below the mattress, and wherein the mattress is in compressive contact with the side rails and between the headboard and the footboard when the mattress is horizontal such that there are substantially no gaps between the mattress and the frame when the mattress is horizontal; and d. a scissor linkage to affix the elevating upper substructure to the fixed lower substructure, wherein the scissor linkage comprises at least one set of cross bars forming a scissor hinge, wherein each of the at least one set of cross bars rotatably connects at a fixed position on both the upper substructure and the lower substructure.

* * * * *